US005735608A

United States Patent [19]

Branco

[11] Patent Number: 5,735,608

[45] Date of Patent: Apr. 7, 1998

[54] TOTABLE HAMPER

[76] Inventor: Marlene Branco, 435 Riverside Ave., Westport, Conn. 06880

[21] Appl. No.: 418,310

[22] Filed: Apr. 7, 1995

[51] Int. Cl.[6] ..... B65D 30/04; B65D 33/02

[52] U.S. Cl. ..... 383/25; 190/903; 220/9.1; 383/41; 383/104; 383/119

[58] Field of Search ..... 383/25, 41, 104, 383/3, 119; 190/903, 111, 127; 220/9.1

[56] References Cited

U.S. PATENT DOCUMENTS

| | | | |
|---|---|---|---|
| D. 307,811 | 5/1990 | Branco . | |
| 1,087,702 | 2/1914 | Van Patten | 383/104 |
| 1,318,652 | 10/1919 | Farkas | 383/25 |
| 1,428,098 | 9/1922 | James | 190/127 |
| 1,611,877 | 12/1926 | Le Blang | 383/25 |
| 1,625,668 | 4/1927 | London | 383/104 |
| 1,697,916 | 1/1929 | Kaufmann | 190/903 |
| 1,999,064 | 4/1935 | Marks | 190/903 |
| 2,490,222 | 12/1949 | Lowe . | |
| 2,495,391 | 1/1950 | Smith | 190/903 |
| 2,517,757 | 8/1950 | Adlerstein | 383/41 |
| 2,533,850 | 12/1950 | Syracuse | 190/111 |
| 2,542,477 | 2/1951 | Cart | 220/9.1 |
| 3,128,854 | 4/1964 | Specht | 190/903 |
| 3,173,464 | 3/1965 | Curtis | 383/41 |
| 3,233,644 | 2/1966 | Bono | 220/9.1 |
| 3,310,089 | 3/1967 | Silverman | 220/9.1 |
| 4,044,867 | 8/1977 | Fisher | 383/907 |
| 4,180,113 | 12/1979 | Liebling | 220/9.1 |
| 4,246,945 | 1/1981 | Sterling | 220/9.1 |
| 5,050,998 | 9/1991 | Wachtel . | |
| 5,302,029 | 4/1994 | Weber et al. | 383/3 |

FOREIGN PATENT DOCUMENTS

| | | | |
|---|---|---|---|
| 2240088 | 7/1991 | United Kingdom | 383/119 |

*Primary Examiner*—Stephen P. Garbe
*Attorney, Agent, or Firm*—Handal & Morofsky

[57] ABSTRACT

A portable hamper-like device is disclosed. It comprises a base, a sidewall and a top. The base is such as to allow the bag to rest in stable fashion on the floor. The top of the bag is provided with a zippered opening which allows for the convenient deposit of dirty laundry. A zipper is also provided on the side of the bag to allow for convenient removal of the contents of the bag. This allows easy transfer of laundry into a washing machine. Transportation of the bag is provided for by an adjustable strap attached to the main body of the bag. The bag is maintained in the shape of a hamper by a plurality of support members which are maintained in contact with the sidewall and extend from the base to the top of the bag.

23 Claims, 10 Drawing Sheets

TOTABLE HAMPER

TECHNICAL FIELD

The present invention relates to a device for accumulating and moving dirty laundry.

BACKGROUND

One of the unsightly realities of even the most privileged life is dirty laundry. Every day each of us generates a great deal of dirty laundry which, of necessity, accumulates day by day, sock by sock, and sheet by sheet until the end of the week, when most of us catch up with our accumulations and get them washed, in our own homes, if we are fortunate enough to have a washing machine and dryer, or at the local laundromat.

Typically, laundry is accumulated in hampers, or laundry bags. Hampers usually take the form of a rigid receptacle, often of rectangular configuration and having a hinged cover, which allows the cover to be opened to receive dirty laundry. After receiving the dirty laundry, the cover can be closed and thus presents a pleasant appearance. However, such hampers are relatively expensive to manufacture and bulky. Less expensive versions consist of a bulky plastic shell which must be shipped in its full assembled configuration and is found by retailers to not be a cost effective use of shelf or other selling space. Such shipping is relatively expensive and adds to the manufacturing costs to increase the overall cost to the consumer. As a result, such hampers are not in widespread use.

Still yet another problem with such hampers is the fact that they are not portable and thus one must bend over and dig in deep to get the dirty laundry out of them and move it to a place to be cleaned. Of course, this assumes that the laundry is being accumulated in a place convenient to where it is being generated. In most situations this will be the bedroom. Here both sheets and clothing are changed. Other laundry is generated in the bathroom, where towels, shower curtains, bathroom mats and the like gradually become soiled. A relatively minor amount of laundry is also generated in the kitchen and dining room where such items as hot authors, kitchen towels, table linens and the like may become soiled.

In view of the stationary nature of conventional rigid hampers, it is necessary, in addition to removing laundry and transporting it to a place to be cleaned, to transport laundry to the hamper itself. From a common sense standpoint, location of the hamper hear the point of generation of most of the dirty laundry is most convenient from the standpoint of accumulation. Typically, as discussed above, this point is somewhere near the bedroom, which typically is also close to the bathroom.

However, plastic hampers are quite unsightly and their location in the bedroom is not a preferred situation. One approach to solving the problems of the unsightly hamper is to improve the looks of the hamper. Accordingly, hampers have been designed which are made of wicker, painted white or stained with a desired color. However, such hampers are relatively expensive even compared to plastic hampers, and have thus not seen any widespread use.

As an alternative, many people use plastic baskets such as those marketed by the Rubbermaid Corporation. While these baskets are relatively cheap, they are particularly unattractive. However they do have the advantage of serving both as receptacles for receiving dirty laundry and as totable containers for transporting the dirty laundry to a location for cleaning.

As can be seen from the above discussion, in the case of stationary hampers, it is necessary that the dirty laundry be loaded twice. The first time it must be loaded into the hamper, and the second time it must be loaded into a travel receptacle such as a laundry bag. As an alternative, dirty laundry may be loaded directly into a laundry bag and then transported without reloading to the place where the washing machine is, whether it be a laundry room or a laundromat.

In an attempt to address the above problems, I conceived the idea of a bag which would function both as a hamper and as a laundry bag, by being attractive and portable. My design took the form of a cylinder shaped bag with side and top zippered openings to provide flexibility in filling and discharging. While the shape of my hamper was attractive, when it was filled up, when it was less than filled, its appearance was floppy and ill defined. My ornamental design for a clothing hamper is illustrated in my U.S. Design Pat. No. D 307,811.

SUMMARY OF THE INVENTION

The invention, as claimed, is intended to provide a remedy. It solves the problem of how to provide a hamper which is of attractive configuration, while at the same time having mechanical features which provide for ease of use for the accumulation of dirty laundry and easy portability. The same is achieved by providing a hamper comprising a base, a sidewall and a top. The base is such as to allow the bag to rest in stable fashion on the floor. The top of the bag is provided with a zippered opening which allows for the convenient deposit of dirty laundry. A zipper is also provided on the side of the bag to allow for convenient removal of the contents of the bag. This allows easy transfer of laundry into a washing machine. Transportation of the bag is provided for by an adjustable strap attached to the main body of the bag. The bag is maintained in the shape of a hamper by a plurality of support members which are maintained in contact with the sidewall and extend from the base to the top of the bag.

BRIEF DESCRIPTION OF THE DRAWINGS

One way of carrying out the invention is described in detail below with reference to drawings which illustrate only one specific embodiment of the invention and in which.

DETAILED DESCRIPTION OF THE PREFERRED EMBODIMENTS

Figure 1:
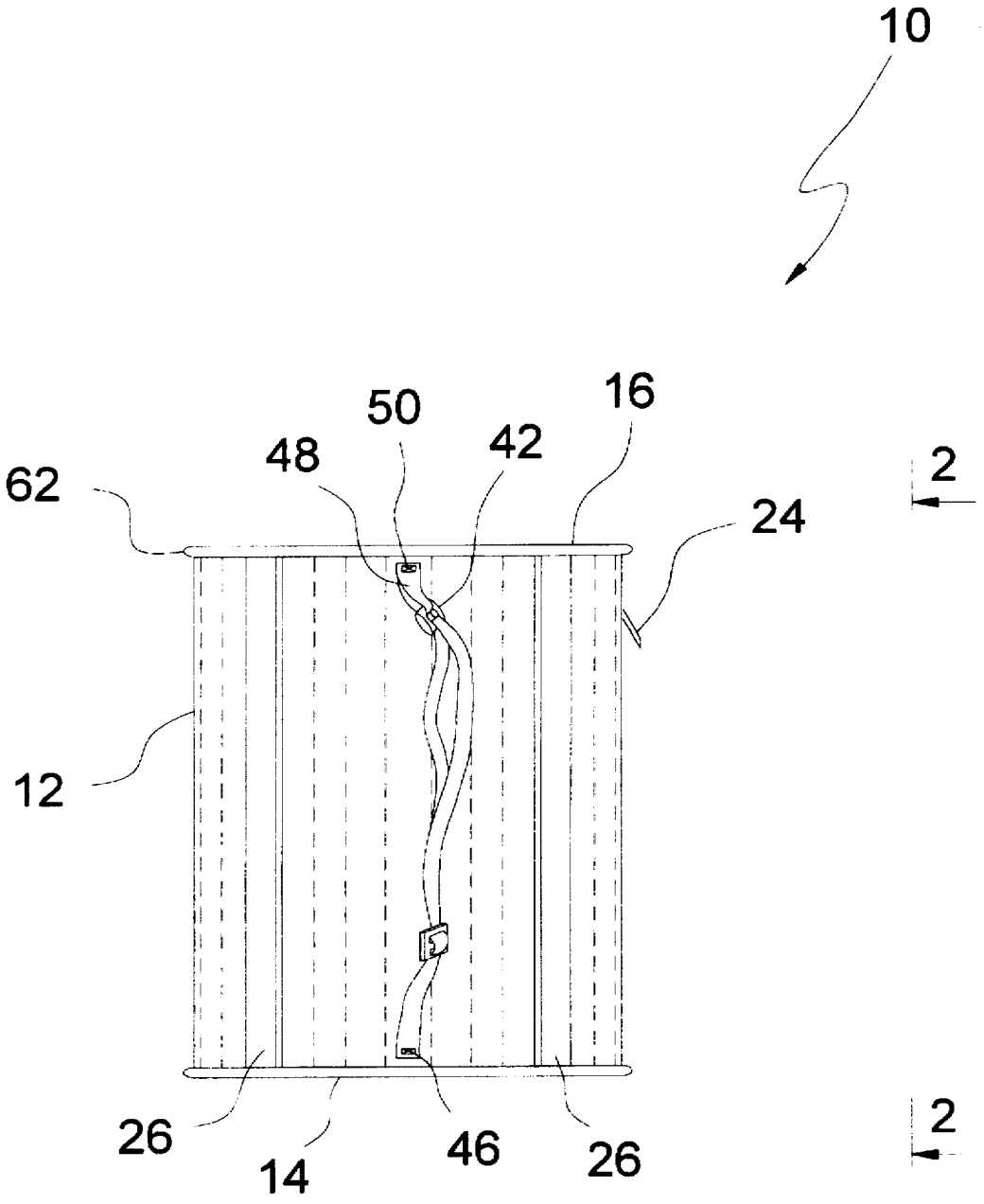
FIG. 1 is a side view of the inventive device constructed in accordance with the present invention.

As illustrated in FIG. 1, the inventive bag 10 has a generally cylindrical configuration. Bag 10 comprises a sidewall 12 made of a conventional quilted material. Bag 10 is supported on a base 14 and is closed by a top 16. Top 16 and base 14 are both made of conventional quilted material of the type which comprises, for example, planar fibrous polyester sheeting with both sides covered by a woven fabric such as cotton.

Figure 2:
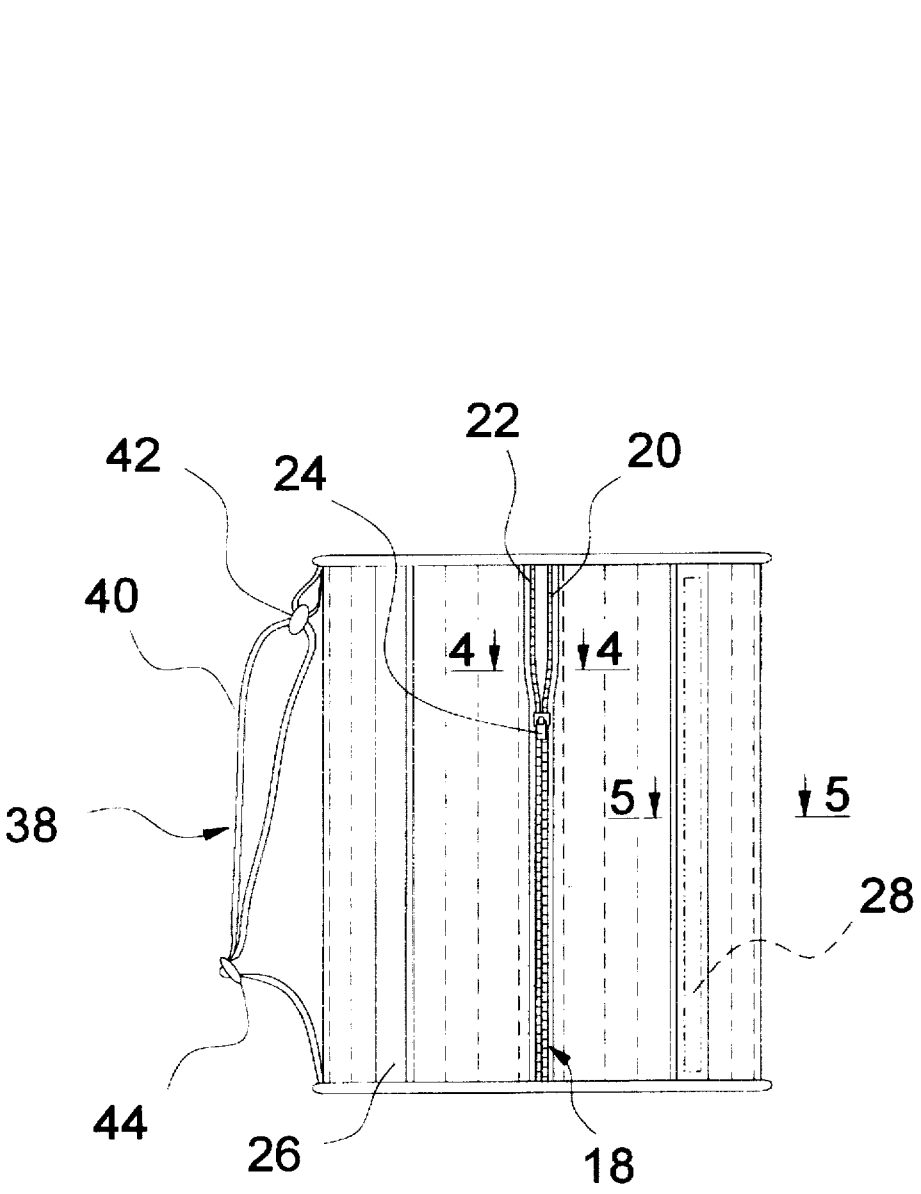
FIG. 2 is a is a view along lines 2—2 of FIG. 1.

As illustrated in FIG. 2, a zipper 18 is provided on the side of bag 10. Zipper 18 is a conceptual design and may be a brass zipper or one of the more modern types of closures, such as a teflon zipper or a hook and eye closure such as that marketed by the Velcro Corporation.

Zipper 18 comprises mating teeth 20 and 22. Zipper 18 is operated by a pull 24. Zipper 18 extends the full length of bag 10 and thus provides for easy unloading of the contents of bag 10.

Figure 3:
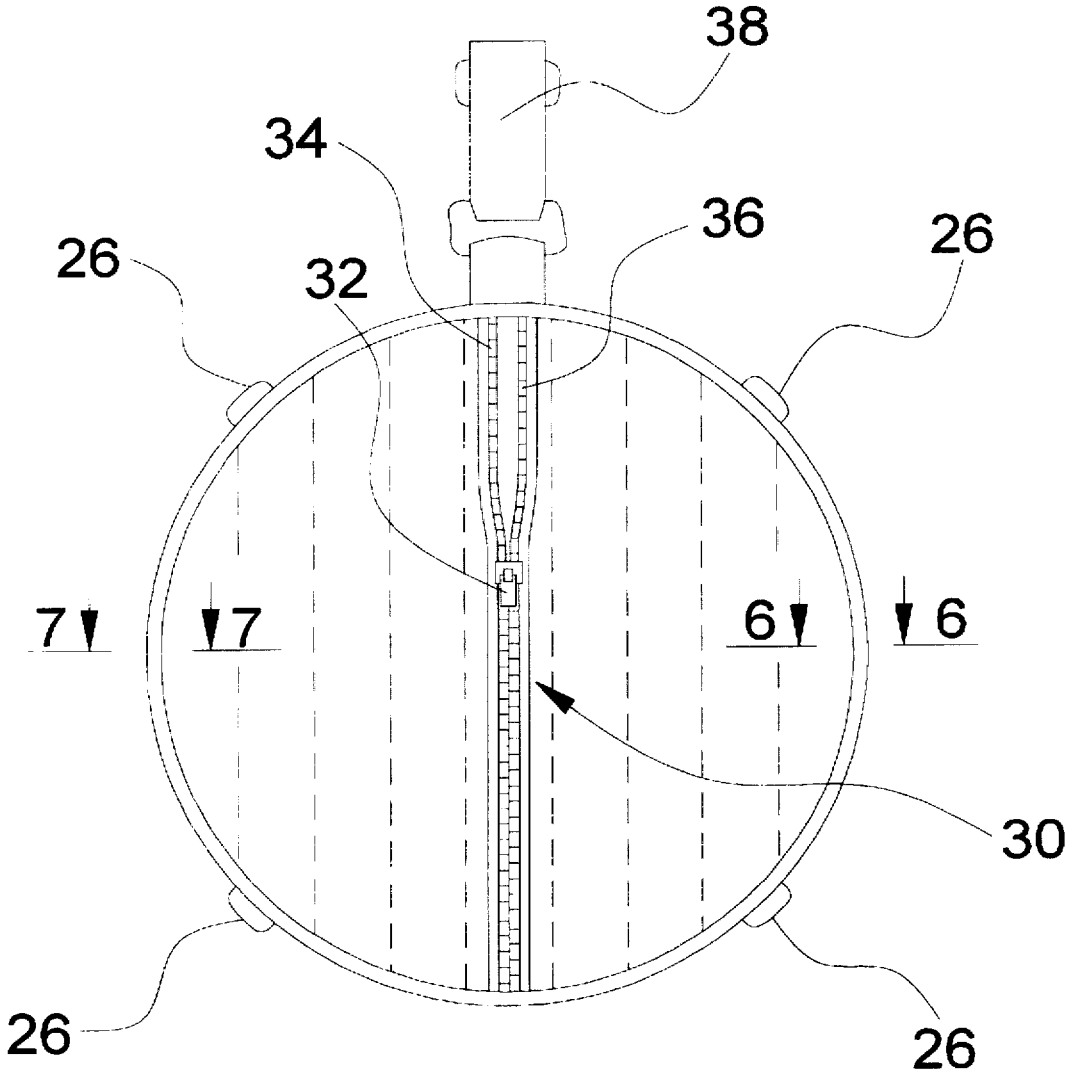
FIG. 3 is a top view of the inventive device.

As can be seen most clearly in FIG. 1, the sides of the bag 10 are provided with a plurality of pockets for receiving support members. These pockets are defined by fabric ribbons 26. There are four fabric ribbons 26, as is illustrated most clearly in FIG. 3. Each of these fabric ribbons 26 extends the length of bag 10. These fabric ribbons 26 are positioned at equal distances with respect to each other. This allows for even support of the entire bag 10, allowing it to take the form of a hamper, even when there is nothing inside of it. Naturally, however, this only works well when the bag is resting on its base 14.

As can be seen most clearly with reference to FIG. 2, support is provided by a plurality of plastic rods made of "DELRIN" (actual resin) brand plastic or any similar plastic. In the alternative plastic tubes may be used. This is illustrated in phantom lines because the same are hidden by ribbons 26.

Easy filling of the bag is provided by a second zipper 30 which includes a pull 32 and facing sets of teeth 34 and 36. As can be seen in FIG. 30, zipper 30 extends the full length of the top 16 of bag 10.

A handle 38 provides for the the transport of bag 10. Handle 38 comprises a strap 40 looped around a brass ring 42 and secured to a brass slider 44 to provide an adjustable length in a conventional manner. One side of handle 38 is secured to sidewall 12 by stitches 46. Brass ring 42 is secured to sidewall 12 by a loop of strapping material 48 which is secured by stitches 50 to sidewall 12.

Figure 4:
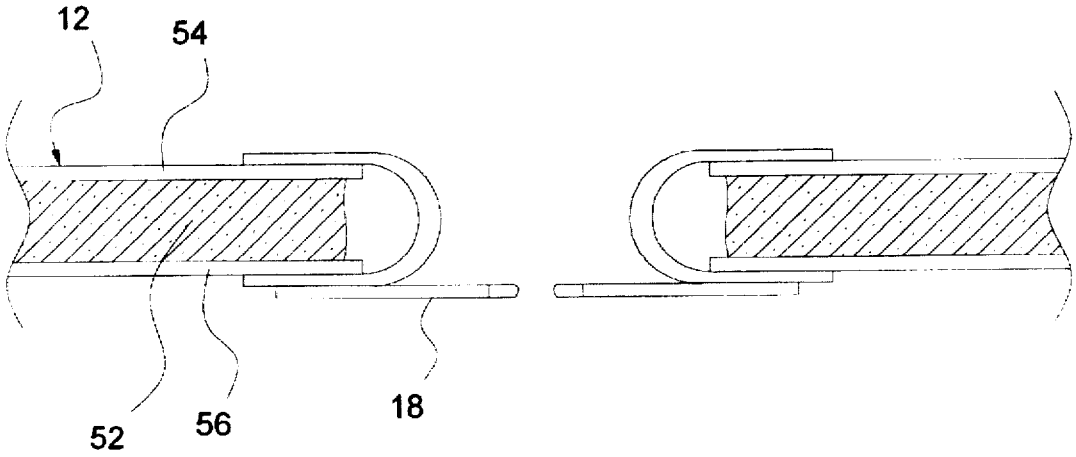
FIG. 4 is a view in cross-section along lines 4—4 of FIG. 2.
Figure 5:
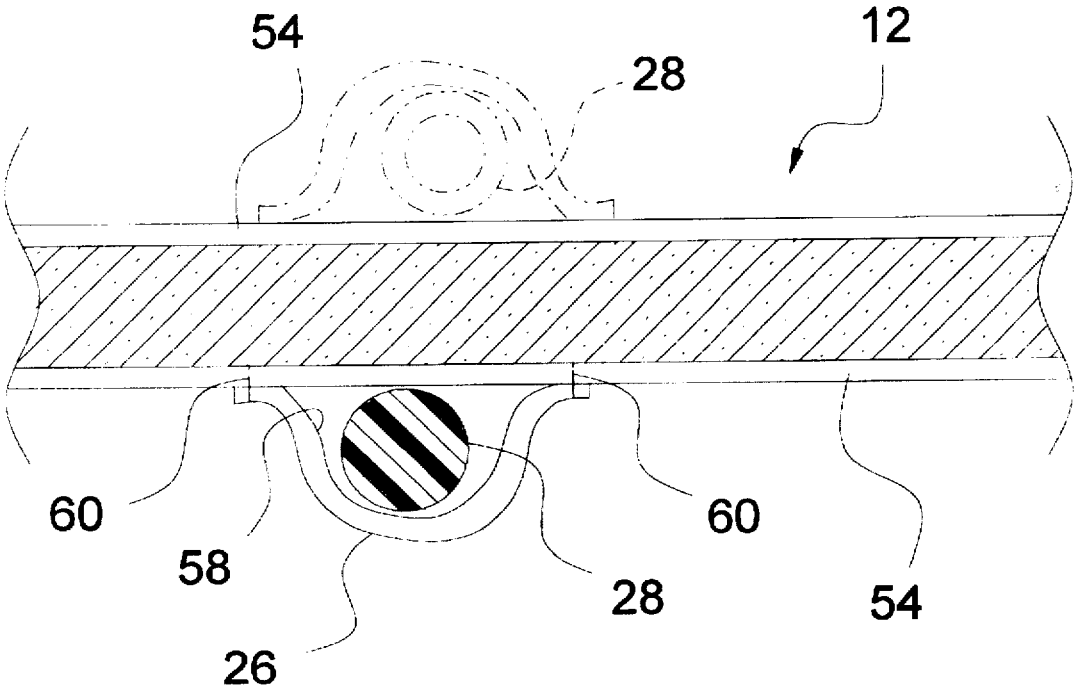
FIG. 5 is a view in cross-section along lines 5—5 of FIG. 2.

Referring to FIG. 4, the construction of the inventive bag 10 may be more clearly understood. In particular, sidewall 12 comprises batting material made of polyester fibers 52 surrounded by an outer skin 54 made of cotton and an inner skin 56 which may also be made of woven fabric. As illustrated in FIG. 5, rods 28 are contained in pockets 58, which are defined by ribbons 26 which are made of cotton and are secured by stitching 60 to sidewall 12. Alternatively, rods or tubes 28 may be positioned on the inside of bag 10, as illustrated in phantom lines in FIG. 5.

Figure 6:
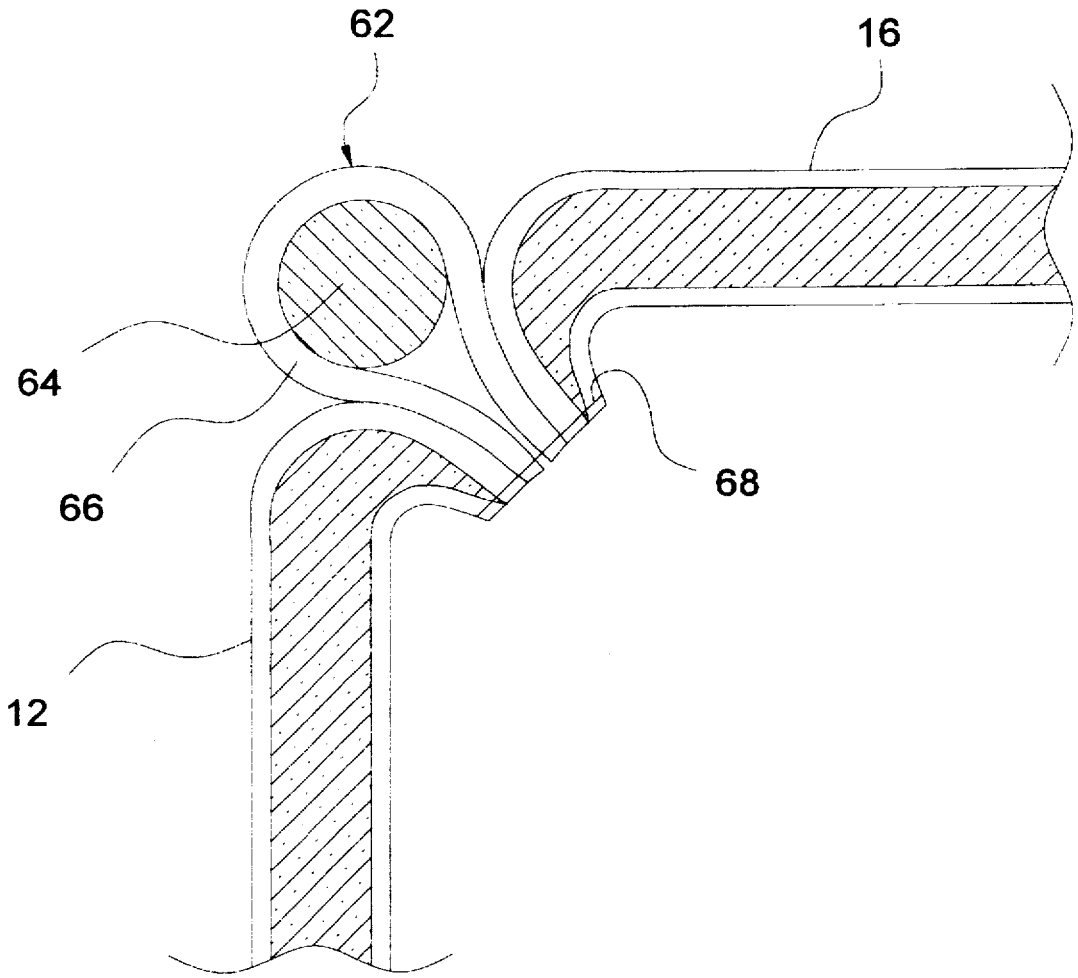
FIG. 6 is a view in cross-section along lines 6—6 of FIG. 3.

As illustrated in FIG. 1, welting 62 is provided on bag 10 for both support and appearance. Turning to FIG. 6 welting 62 comprises a central fibrous bead 64 held within a ribbon 66. Ribbon 66 is secured at the interface of top 16 and sidewall 12 by stitching 68.

Figure 7:
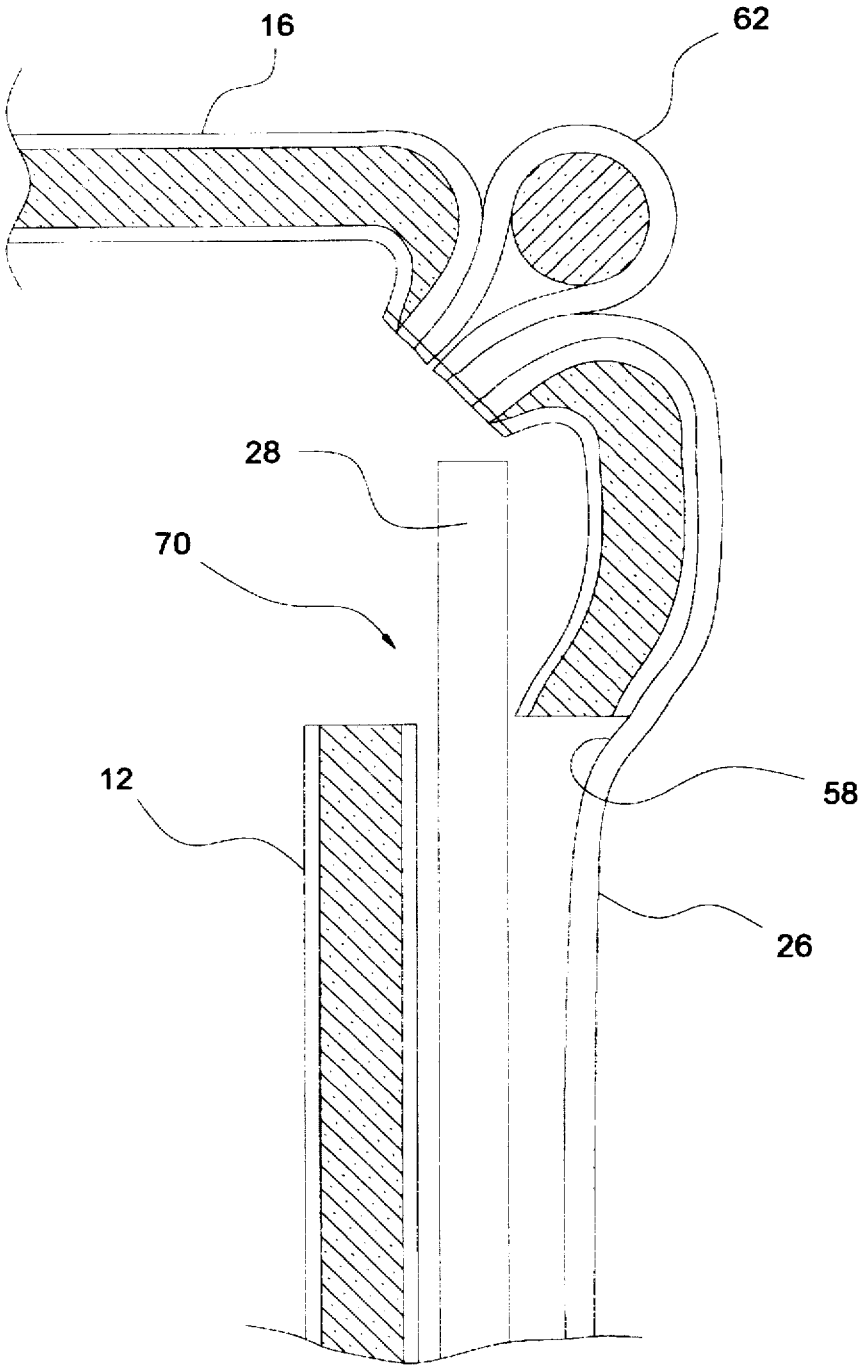
FIG. 7 is a view along lines 7—7 of FIG. 3.

Turning to FIG. 7, the formation of pockets 58 may be understood. In particular, the pockets are formed by ribbons 26 and sidewall 12. In order that the rods 28 may be removed, a slit 70 is provided in sidewall 12 for each of the four rods 28.

During use, bag 10 sits in the position illustrated in FIG. 1, but with its zipper 30 fully open and its zipper 18 fully closed. In accordance with the preferred embodiment of the invention it is expected that the bag 10 will be made of fabric which matches the sheets and other linens in the bedroom or bathroom. Accordingly, the bag 10 may be placed in the bedroom or bathroom without being unsightly. As laundry is generated, the same may simply be thrown into the inventive bag 10 and will fall of its own weight through the opening provided by zipper 30.

After a sufficient quantity of laundry has been collected, the zipper 30 may simply be closed and the Bag taken by handle 38 and carried to the laundry room or into the car for transport to a laundromat. The zipper on the side of the bag 10, that is zipper 30, may then be opened and the laundry transfered into the washing machine. Because the zipper is not directly underneath the carrying handle 38, it will fall in unobstructed fashioned out of the bag into the washing machine. Likewise, because the zipper is not on the bottom of the bag, the tendency of fabric to catch in the zipper as it is opening and pull the facing teeth apart making opening of the zipper more difficult, does not exist and most easy operation is achieved.

Figure 8:
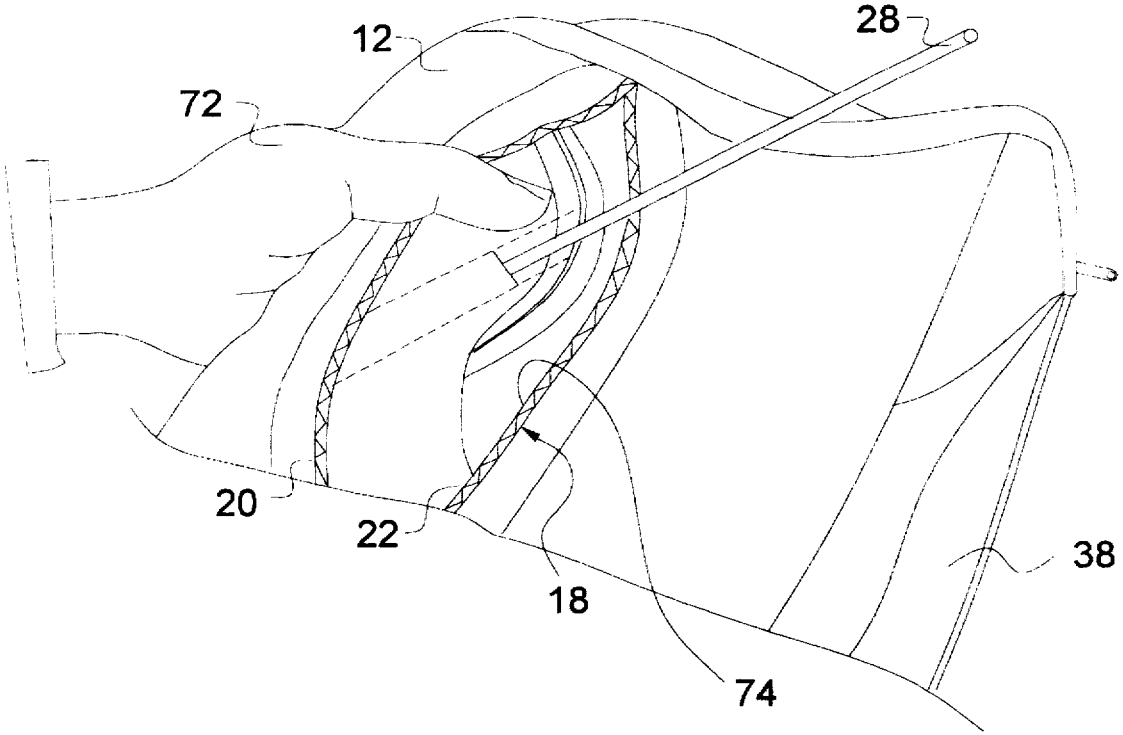
FIG. 8 is an illustration in perspective showing the removal of a support rod from the inventive device.

As has been discussed above, it is possible in accordance with the invention to remove the rods 28 for the purpose of laundering the inventive bag. One way of doing this is illustrated in FIG. 8. In accordance with the present invention, the user takes his hand 72 and pushes the sidewall 12 out through the opening 74 created by zipper 30 after zipper 30 has been opened. It is then possible to pull rod 28 and remove it. All rods 28 in the inventive bag are then removed, thus allowing the bag to be laundred.

Figure 9:
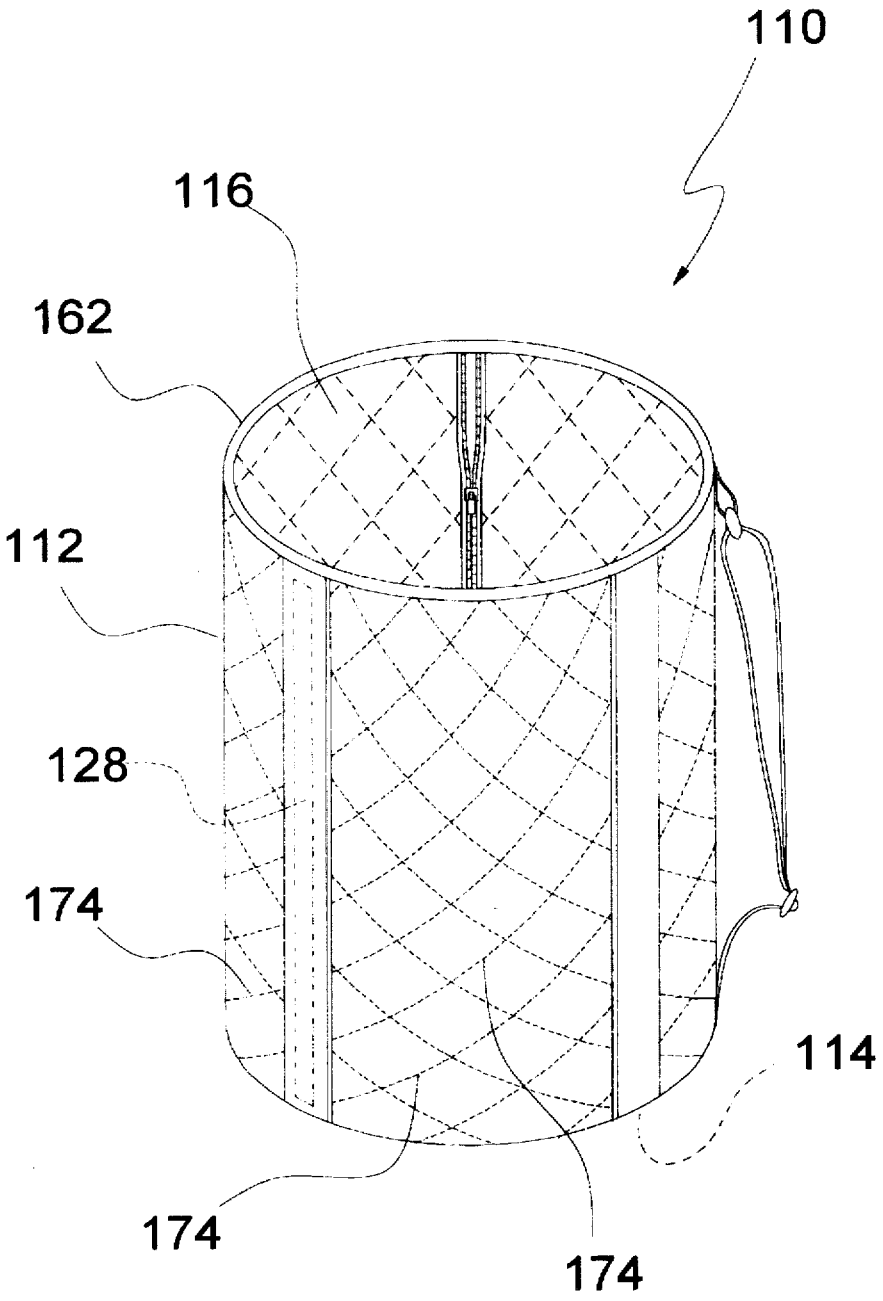
FIG. 9 is a perspective view of an alternative embodiment of the present invention.

Referring to FIG. 9, a preferred embodiment of the present invention is illustrated. More particularly, in accordance with this embodiment of the invention a bag 110 is provided. Bag 110 has most of the same features as bag 10, but is instead provided with diamond shaped quilting 174 of conventional design. This bag has a height of approximately 50 cm and a diameter of about 36 cm. The quilted material of which the bag is made, is of relatively thick dimension, having a thickness on the order of about 0.5 centimeters. Of course, thicker dimension material may be used and acceptable results can economically be achieved in a range between 0.25 and 0.75 cm.

Rigidity and form is provided by welting 162 which has a thickness in the range of about 1 cm. Here again, somewhat smaller welting thickness and certainly larger welting thicknesses will yield acceptable results without increasing costs dramatically. In particular, it is noted that the welting provides a support function much like a horizontal strut in a building serving to keep adjacent vertical support rods 128 separated at a predetermined distance with respect to each other. The integrity of the structure is completed by the rods which fit tightly in the pockets, bearing against the pocket ends adjacent top 116 and bottom 114, not visible in FIG. 9.

Generally, in order to maintain the structural integrity of the system, it is necessary that the material of which sidewall 112 is made be stiff enough to function as a support element in combination with welting 162. As can be seen from the above, to a limited extent, a relative reduction in the thickness of the sidewall 112 may be compensated for in by an increase in the thickness of welting 162.

Figure 10:
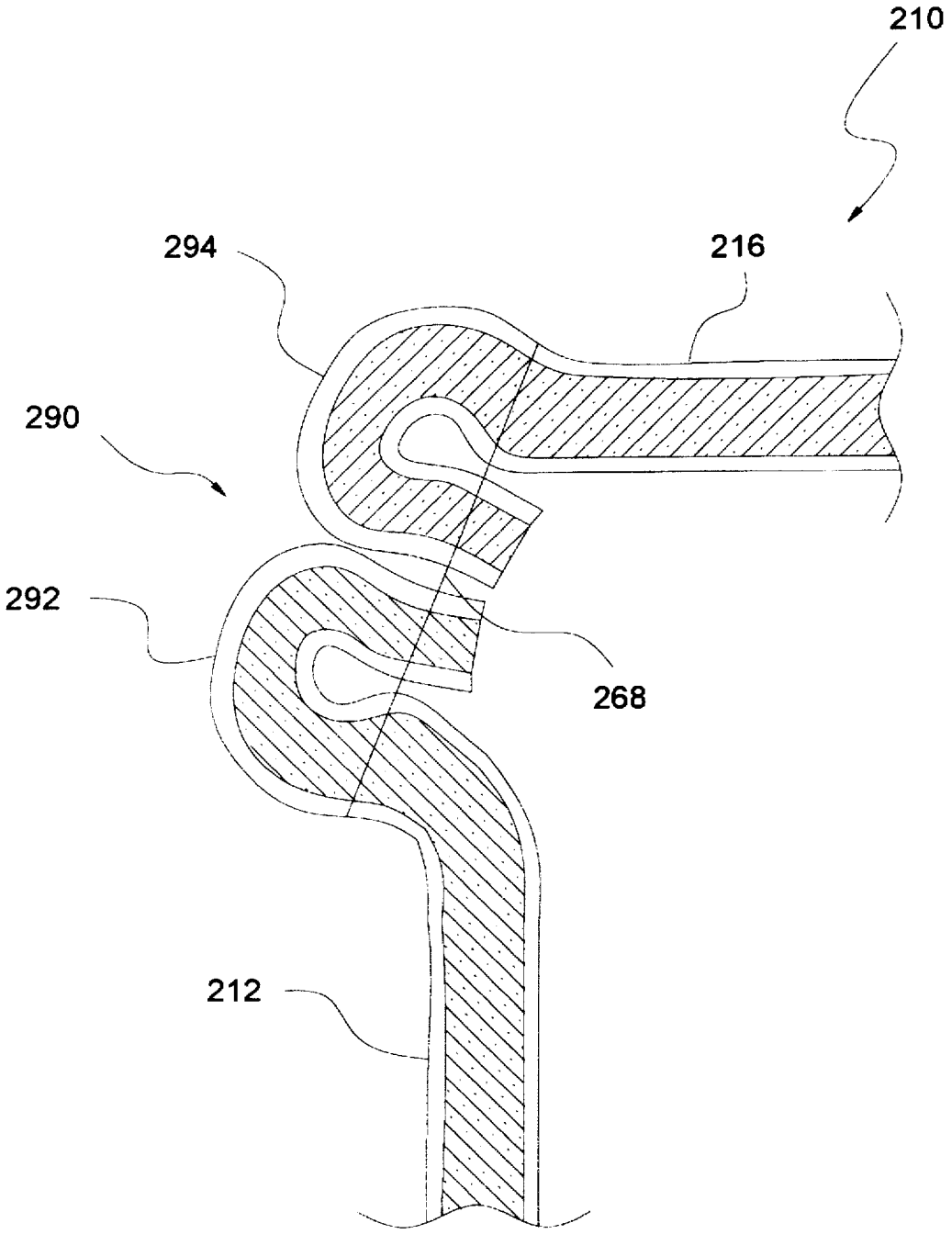
FIG. 10 is a view similar to that of FIG. 6 illustrating an alternative construction.

Referring to FIG. 10, an alternative construction of a bag 210 constructed in accordance with the present invention is illustrated instead of welting 162, the bag has a bound edge 290 which comprises a pair of adjacent, folded fabric members such as sidewall 212 and top 216. The edges of sidewall 212 and top 216 are folded into hems 292 and 294, respectively and maintained in the illustration by stitching 268. The result is a bag which can be manufactured without being inside-out and without the added cost of welting.

While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. Apparatus for accumulation and transportation of dirty laundry, comprising:

a) a base made of a planar pliable material;

b) a top made of a planar pliable material;

c) a sidewall extending from said base to said top and secured to said base and said top to form a hamper, said base, top, and sidewall defining an internal receptacle volume for receiving dirty laundry;

d) a plurality of separate support members associated with said sidewall for maintaining the shape of said apparatus, wherein said support members are spaced from each other and secured at a point adjacent to said top, and, together with said top and said sidewall, tend to support said sidewall in a position which maintains said internal receptacle volume; and e) an openable closure in said top, said closure defining an opening for the placement of dirty laundry into said internal receptacle volume.

2. Apparatus as in claim 1, further comprising a strap for carrying said apparatus.

3. Apparatus as in claim 2, wherein said strap extends substantially from said top to said base.

4. Apparatus as in claim 1, wherein said support means comprises flexible plastic rods.

5. Apparatus as in claim 1 wherein said support means is removable.

6. Apparatus as in claim 1 wherein said openable closure is a zipper.

7. Apparatus as in claim 1, wherein said base and sidewall are made of a pliable material, said support members comprising a plurality of rods spaced around the periphery of said top and said base, wherein said rods and said top and said sidewall support said sidewall in said position.

8. Apparatus as in claim 1, wherein said pliable material is stiff enough to keep said support members separated from each other.

9. Apparatus as in claim 1, wherein said sidewall is made of said pliable material.

10. Apparatus as in claim 1, wherein said sidewall is in the form of a cylindrical wall.

11. Apparatus as in claim 1, wherein each of said support members is secured to said top by being secured to said sidewall at a respective point proximate to said top.

12. Apparatus as in claim 1, wherein said pliable material comprises a multi-layered structure comprising layers of fabric and planar fibrous material.

13. Apparatus as in claim 1, wherein said support members are rods secured in sleeves positioned along the length of said sidewall.

14. Apparatus as in claim 1, wherein said support members are contained within sleeves defined in said sidewall.

15. Apparatus as in claim 14, wherein said sleeves defined in said sidewall are open at one end and blocked by the body formed by said top, bottom and sidewall, and said sleeves are defined in said sidewall on the inside of said body formed by said top, bottom and sidewall.

16. Apparatus for accumulation and transportation of dirty laundry, comprising:

a) a base;

b) a sidewall made of a pliable material extending upwardly from said base;

c) welting secured to the top of said sidewall to form a peripheral edge said welting forming a shape retaining gathering of material at said edge, said base and said sidewall defining an internal receptacle volume for receiving dirty laundry; and d) a plurality of separate substantially vertical support members associated with said sidewall for maintaining the shape of said apparatus, said gathering being stiff enough to maintain separation between said support members.

17. Apparatus as in claim 16, further comprising a top secured along the top of said sidewall.

18. Apparatus as in claim 17, further, comprising:

e) a first openable closure defining an opening for the placement of dirty laundry into said internal volume; and f) a second openable closure in said sidewall, said second openable closure defining an opening for the removal of dirty laundry from said internal volume.

19. Apparatus as in claim 18, wherein said first openable closure is defined in said top.

20. Apparatus for accumulation and transportation of dirty laundry as in claim 18, further comprising a strap extending from one point on said sidewall to another point on said sidewall and wherein said strap and said second openable closure are angularly displaced with respect to each other.

21. Apparatus for accumulation and transportation of dirty laundry, as in claim 17, wherein said sidewall extends from said base to said top and is secured to said base and said top along the peripheral edge of said top to form said welting.

22. Apparatus as in claim 16, further comprising a strap for carrying said apparatus.

23. Apparatus for accumulation and transportation of dirty laundry, comprising:

a) a base made of a planar pliable material;

b) a top made of a pliable material;

c) a sidewall made of a planar pliable material extending from said base to said top and secured to said base and said top to form a hamper body, said base, top, and sidewall defining an internal receptacle volume for receiving dirty laundry;

d) support members associated with said sidewall for maintaining the shape of said apparatus, said support members comprising a plurality of spaced support members connected only to each other by said hamper body and oriented in a generally vertical direction and secured to said top, said pliable material being stiff enough to maintain said support members in positions separated from each other; and e) an openable closure defining an opening for the placement of dirty laundry into said internal receptacle volume.

* * * * *